United States Patent [19]

Jacobsen

[11] 4,427,489

[45] Jan. 24, 1984

[54] MIXING DEVICE AND METHOD

[75] Inventor: Finn Jacobsen, Karlstad, Sweden

[73] Assignee: Kamyr AB, Karlstad, Sweden

[21] Appl. No.: 276,008

[22] Filed: Jun. 22, 1981

[30] Foreign Application Priority Data

Aug. 19, 1980 [SE] Sweden ..... 80058233

[51] Int. Cl.[3] ..... B01F 5/00; B01F 7/00; D21C 9/10

[52] U.S. Cl. ..... 162/57; 162/65; 162/66; 366/102; 366/169; 8/156; 68/181 R

[58] Field of Search ..... 162/57, 65, 66; 366/102, 103, 104, 169, 316; 261/87; 8/156; 68/181 R

[56] References Cited

U.S. PATENT DOCUMENTS 1,580,834 4/1926 McClelland ..... 261/87
3,525,504 8/1970 Colwell ..... 366/316

FOREIGN PATENT DOCUMENTS 2920337 12/1979 Fed. Rep. of Germany ..... 162/55
172981 12/1955 Sweden .
354789 6/1968 Sweden .
633573 11/1978 U.S.S.R. ..... 366/102

*Primary Examiner*—William F. Smith
*Attorney, Agent, or Firm*—Cushman, Darby & Cushman

[57] ABSTRACT

An apparatus and method for mixing a fluid, such as chlorine or oxygen gas, into a suspension, such as comminuted cellulosic material. A circular cross-section conduit defines a flow path for a suspension, and a circular smooth-faced disc is mounted in the conduit for rotation, covering substantially the entire interior of the conduit. A relatively small opening extends through the disc, and that disc is rotated in the conduit with small portions of suspension flowing in the conduit progressively passing through the opening and being fluidized when passing through the opening. The fluid is introduced into the suspension as the suspension flows through the opening, and in this way an even distribution of fluid in the suspension, with minimum power consumption, is provided.

16 Claims, 7 Drawing Figures

Fig. 3
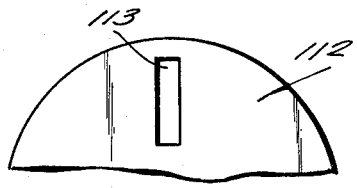
Fig. 4
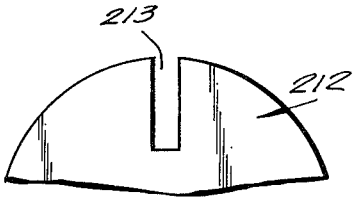
Fig. 6
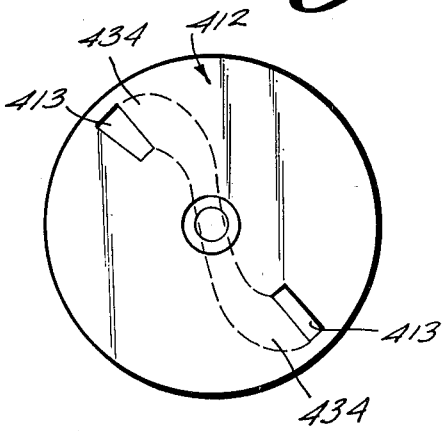
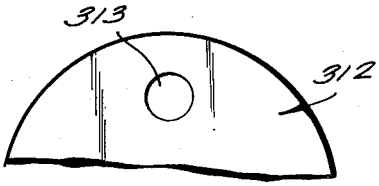
Fig. 5
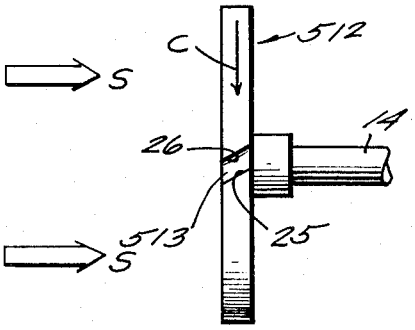
Fig. 7

MIXING DEVICE AND METHOD

BACKGROUND AND SUMMARY OF THE INVENTION

The invention relates to an apparatus and method for effectively mixing-in a fluid into a suspension, or fluid and is particularly adapted for the mixing of a treatment fluid into a comminuted cellulosic material suspension. The mixing of chemicals in pulp of medium consistency (i.e. about 5 to 15% solids consistency, preferably about 8 to 12% solids consistency) is particularly appropriate for the practice of the present invention.

Mixing apparatus is known in the prior art, such as shown in Swedish Pat. Nos. 172,981 and 354,789, wherein treatment fluid is passed through one or more movable outlet openings which form spiral-shaped "traces" in the pulp since the pulp has a more or less linear flow and the openings move in circles. While these prior art structures do effect mixing, there are disadvantages associated therewith in that a part of the pulp passes at a distance from the outlet openings and does not receive a sufficient amount of treatment medium. Furthermore, since the openings are provided in rotating arms or wings, a considerable resistance arises to the rotation of the fluid introducing apparatus thereby increasing power consumption, especially with medium consistency pulp and the like (i.e. about 5 to 15% consistency pulp).

According to the present invention, an apparatus and method are provided that effect an even distribution of treatment fluid or the like into a suspension with a minimum of power consumption. The effectiveness of the distribution and mixing depends upon many factors such as the pulp concentration, the fluid quantity to be added and the speed of reaction of the treatment fluid with the suspension, etcetera. According to the present invention it is possible to provide uniform distribution and mixing even when these factors vary widely.

Generally, the higher the concentration of solids in the suspension the more difficult it is to evenly distribute the treatment fluid. Also, the more quickly the treatment fluid reacts with the suspension the more important it is to distribute and mix the fluid in as quickly and evenly as possible. This is especially true with respect to the chlorine bleaching of paper pulp. In order not to dilute the pulp with an undesirable quantity of liquid, chlorine is usually added as a gas dispersed in a relatively small quantity of liquid. Chlorine has a quick initial reaction with the pulp and difficulties therefore arise in the even distribution of such a small quantity. According to the present invention, however, it is practical to provide even distribution of treatment fluid into the suspension even where the treatment fluid reacts quickly with the suspension, and the solids consistency of the suspension is high. For instance according to the present invention it is possible to effect chlorine bleaching of pulp of medium consistency (i.e. about 5 to 15%), with a minimum of power consumption and without any dilution.

According to one aspect of the present invention apparatus for effecting mixing of the fluid into a suspension is provided which comprises the following components: A conduit having at least a portion thereof that is substantially linear and substantially circular in cross-section. A substantially smooth-faced circular disc having an area substantially the same as, or slightly less than, the circular cross-section of the conduit. Means defining a through-extending opening in the disc, the opening having a small area compared to the area of the disc. Means for mounting the disc for rotation in the conduit substantially linear, substantially circular cross-section portion, about an axis of rotation substantially concentric with the conduit circular cross-section portion. And, means for introducing the fluid into the opening. The disc mounting means preferably comprises a hollow shaft while the means for introducing the fluid into the opening comprises the hollow shaft, a fluid passageway extending from the shaft to a source of fluid remote from the conduit, and means defining a cavity in the disc in operative communication with the both the hollow shaft and the opening. A motor or like means is provided for rotating the disc and shaft at a speed of about 300 to 1500 rpm.

According to another aspect of the present invention a method of mixing a fluid into a suspension is provided, particularly for mixing a treatment fluid (like chlorine or oxygen gas) into a medium consistency comminuted cellulosic material suspension (i.e. 5 to 15% solids consistency pulp). The method comprises the following steps: Defining a flow path for the suspension past an area of mixing fluid introduction. Moving the suspension along the flow path so that prior to and after the area of mixing fluid introduction it has a velocity below fluidizing velocity. Effecting turbulent fluidization, at any given time, of a small part of the suspension flowing in the flow path adjacent the area of mixing fluid introduction at the area of mixing fluid introduction. Evenly and uniformly introducing mixing fluid into the fluidized part of the suspension when fluidized; and progressively treating all parts of the suspension flowing in the flow path so at some time substantially the entire suspension flowing in the flow path will be subjected to turbulent fluidization and fluid introduction.

It is the primary object of the present invention to provide for the effective distribution and mixing-in of a fluid in a suspension with minimal power consumption. This and other objects of the invention will become clear from an inspection of the detailed description of the invention and from the appended claims.

BRIEF DESCRIPTION OF THE DRAWINGS

FIGS. 3 through 6 are partial end views of other embodiments that the rotating disc of the apparatus of FIG. 1 could take; and FIG. 7 is a side view of another embodiment of an exemplary disc utilizable in the apparatus of FIG. 1.

DETAILED DESCRIPTION OF THE DRAWINGS

Figure 1:
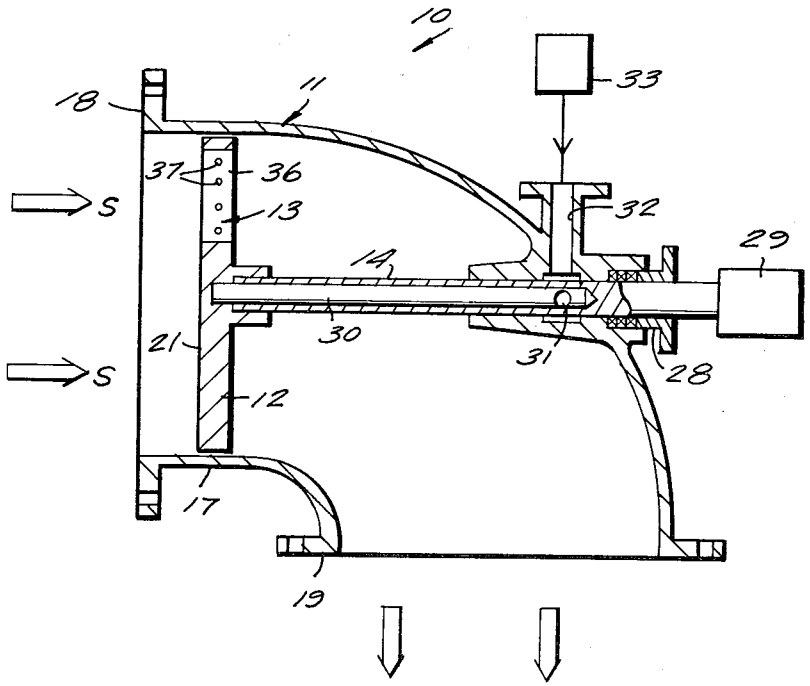
FIG. 1 is a lengthwise cross-sectional view of an exemplary apparatus according to the present invention, generally taken along lines A—A of FIG. 2.

Exemplary apparatus according to the present invention is shown generally at 10 in FIG. 1. The apparatus is for effecting mixing of a fluid into a suspension, being particularly adapted for evenly mixing and distributing a treatment fluid (such a chlorine gas) into a medium consistency suspension (such as a comminuted cellulosic material suspended in an aqueous medium, and having a solids consistency of about 5 to 15%, preferably about 8 to 12%).

The basic components of the apparatus 10 include a conduit 11, a disc 12 having an opening 13 therein, a shaft 14 or the like for mounting the disc 12 for rotation, and means for introducing a fluid into the opening 13.

The conduit 11 may take a wide variety of forms but preferably has at least a portion 17 thereof that is substantially linear and substantially circular in cross-section. As illustrated in FIG. 1, it is desirable to provide the conduit 11 as a bent pipe section for ease of mounting of the disc 1 for rotation. An inlet end 18 of the conduit 11 is connected up to a source of suspension, such as a supply line of paper pulp from a digester or storage vessel, while the opposite end 19 of the conduit 11 comprises an outlet end that is connected up to a further suspension-transporting, storage, or treatment device.

The disc 12 has a substantially smooth face 21 which is presented to the flowing suspension indicated by arrows S, and is substantially circular (see FIG. 2), and has an area substantially the same as, or slightly less than, the circular cross-section portion 17 of the conduit 11. For instance the area of the disc 12 may be such that only a small clearance, on the order of about 0.5 millimeters, is provided between the external periphery 22 of the disc 12 and the internal periphery of the substantially circular cross-section 17 of the conduit 11.

The through-extending opening 13 formed in the disc 12 has a relatively small area compared to the area of the disc, and generally should not be so large that it cannot be located within a sector of 45° of the disc 12. The opening may take a wide variety of particular shapes and extents, as illustrated in FIGS. 2 through 7. As preferred design comprises a rectangular slot which has a larger extension in the radial than in the peripheral direction so that the distance between fluid addition points (treatment fluid being added at the opening 13) will be about the same for all portions of the suspension flowing through opening 13 and turbulence will be created in the entire opening 13 when utilizing narrow openings 13, which is advantageous both for mixing and through-flow functions.

A modified form of disc, indicated by reference numeral 112, is shown in FIG. 3 with a rectangular radially extending opening 113 formed therein. In FIG. 4 a modified form of dics is shown by reference numeral 212 having a radially extending rectangularly shaped opened-end slot 213 formed therein. In the FIG. 5 embodiment a modified form of the disc is shown by reference numeral 312 having a circular opening 313 therein. In the FIG. 6 embodiment, two different openings 413, each having generally the configuration of the opening 113 in the FIG. 3 embodiment, are associated with a modified form of the disc indicated by reference numeral 412. In the FIG. 7 embodiment the modified form of disc is indicated by reference numeral 512 and has a generally slot-shaped opening 513 formed therein corresponding generally in shape to the slot 213 in the FIG. 4 embodiment except that the opening 513 is defined by angled radial side surfaces 25, 26 so that during rotation in the direction of arrow C the surfaces 25, 26 assist in transporting the pulp through opening 513 by a propeller effect. In both the FIGS. 1 and 7 embodiments the pulp suspension is intended to flow in the direction of arrows S, however the pulp can flow in the opposite direction as long as the direction of rotation C of the disc 12, 512 is reversed.

The means for mounting the disc 12 for rotation in the conduit 11 mounts the disc 12 for rotation about an axis substantially concentric with the conduit portion 17, and includes the shaft 14 which preferably is hollow. The shaft 14 runs through a stuffing box 28 to a bearing and drive device 29 which effects rotation of the disc 12, preferably at a speed of about 300 to 1500 rpm.

Figure 2:
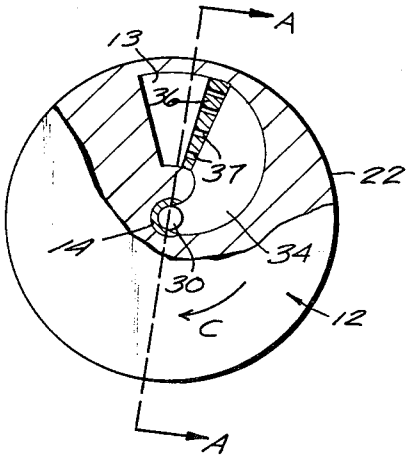
FIG. 2 is an end view, partly in cross-section and partly in elevation, of the rotating disc element component of the apparatus of FIG. 1.

The means for introducing a fluid into the opening 13 includes the hollow interior 30 of the shaft 14, a hollow passgeway defined by one or more openings 31 in shaft 14, an inlet 32 to a source 33 of treatment fluid remote from the conduit 11, and means defining a cavity 34 in the disc 12 (see FIG. 2) in operative communication with both the hollow shaft 30 and the opening 13. As illustrated in FIG. 2, the cavity 34 preferably has a diverging shape which serves to prevent pulp from penetrating further into, and possibly plugging, the fluid treatment inlet when the apparatus 10 is at a standstill. The diverging shape illustrated in FIG. 2 makes it easy to lossen a possible plug when the pressure is put on the treatment medium. Of course a cavity 34 will be provided for each opening 13 in the disc 12, as illustrated schematically by the cavities 434 associated with the openings 413 in the FIG. 6 embodiment. The number of cavities 34 and openings 13 will be chosen depending upon the particular treatment requirements, treatment fluid properties, disc velocity, and other factors.

In the embodiment illustrated in FIG. 2, a dividing wall 36 having a plurality of nozzle openings 37 formed therein divides the cavity 34 from the opening 13. The nozzle openings 37 may be round holes, slots, or the like. If desired, the dividing portion 36 may be eliminated and the cavity 34 may freely communicate with the opening 13. The cavity 34 and divider 36 are arranged with respect to the opening 13 in the manner illustrated in FIG. 2 in contemplation of rotation of the disc in direction C.

Utilizing the apparatus heretofore described, a method of mixing a fluid into a suspension is provided. The method includes the following steps: (a) Defining a flow path for the suspension with conduit 11, past an area provided by cavity 34, etcetera of mixing fluid introduction. (b) Moving the suspension along the flow path in direction S, as by pumping the suspension, at a relatively low velocity so that prior to and after the area of mixing fluid introduction it has a velocity below fluidizing velocity. (c) Effecting turbulent fluidization, at any given time, of a small part of the suspension flow in path S adjacent the area of mixing fluid introduction at the area of mixing fluid introduction. The small portion of the suspension passing through the opening or openings 13 at any given time moves at an increased velocity so that the suspension is fluidized (even though having a solids consistency of about 5 to 15%), and it undergoes turbulent flow when passing through opening or openings 13. (d) Evenly and uniformly introducing mixing fluid into the fluidized part of the suspension when fluidized, as by adding it through cavity 34 and nozzles 37 at opening 13. And (e) progressively treating all parts of the suspension flowing in the flow path so that at some time substantially the entire suspension flowing in the flow path will be subjected to turbulent fluidization and fluid introduction.

It will be seen that these steps are accomplished utilizing the apparatus of FIGS. 1 and 2 by pumping the suspension in flow path S, rotating the disc 12 at a speed of about 300 to 1500 rpm, and introducing the mixing fluid through nozzles 37 at opening(s) 13 as the suspension passes therethrough. The method steps are practiced so that the pressure differential across the opening 13 (in the axial direction) preferably is in the range of about 0.1 to 0.3 kg/cm$^2$. During passage of the pulp through the opening(s) 13 a relatively strong velocity increase is created which, in combination with the fast rotation of the disc 12, creates a turbulent flow and fluidization of the pulp which effects the best possible conditions for mixing-in of the fluid being introduced.

Actual experiments conducted on the method and apparatus according to the present invention indicates that the power consumption of the apparatus according to the invention is small compared to many prior techniques. Power consumption is primarily caused by the friction between the suspension fibers and the rotation body. When using a variable drive with the 300 to 1500 rpm, the power consumption has been found to be below 40 horsepower for exemplary apparatus according to the invention, the horsepower requirements depending only upon the r.p.m. and the disc diameter of the device 10. This low power consumption may be due to the fact that pulp flow is put in turbulent movement only during a fraction of a second and of the friction reducing effect of the fluid introduced which may be liquid, gas, powder, or mixtures thereof. Risk of plugging or clogging of the suspension passage through the unit is eliminated by the fact that the opening(s) are in continuous rapid motion relative to the suspension, effectively preventing fiber network build-up in front of the opening(s), such build-up frequently causing stoppage in static mixer types. The uniform mixing which takes place is primarily a result of the combination of the even distribution of the treatment fluid in the relatively quick flowing suspension through the opening(s) 13, and the turbulence which is caused during and after the passage through such opening(s) 13.

It will thus be seen that according to the present invention a method and apparatus have been provided for the uniform distribution of a fluid into a suspension with minimal power consumption. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for effecting mixing of a fluid into a suspension, or other fluid comprising:

a conduit having at least a portion thereof that is substantially linear and substantially circular in cross-section;

a substantially smooth-faced circular disc having an area substantially the same as, or slightly less than, the circular cross-section portion of said conduit;

means defining a single through-extending opening in said disc extending therethrough in said conduit linear dimension, said opening having a small area compared to the area of said disc and being located within a sector of 45° of the disc cross-section;

means for mounting said disc for rotation in said conduit substantially linear, substantially circular in cross-section portion, about an axis of rotation substantialy concentric with said conduit circular cross-section portion; and means for introducing a fluid directly into said opening from the interior of said disc.

2. Apparatus for effecting mixing of a fluid into a suspension, or other fluid, comprising:

a conduit having at least a portion thereof that is substantially linear and substantially circular in cross-section;

a substantially smooth-faced circular disc having an area substantially the same as, or slightly less than, the circular cross-section portion of said conduit;

means defining a through-extending opening in said disc extending therethrough in said conduit linear dimension, said opening having a small area compared to the area of said disc and said opening being slot-shaped with a greater extension in the radial than in the peripheral direction;

means for mounting said disc for rotation in said conduit substantially linear, substantially circular in cross-section portion, about an axis of rotation substantially concentric with said conduit circular cross-section portion; and means for introducing a fluid directly into said opening from the interior of said disc.

3. Apparatus as recited in claims 1 or 2 wherein said means for mounting said disc includes a hollow shaft; and wherein said means for introducing a fluid into said opening comprises: said hollow shaft; a fluid passageway extending from said hollow shaft, and in operative communication therewith, to a source of fluid remote from said conduit; and means defining a cavity in said disc in operative communication with both said hollow shaft and said opening.

4. Apparatus as recited in claim 2 wherein said through-extending opening is located within a sector of 45° of the disc cross-section.

5. Apparatus as recited in claim 1 wherein said through-extending opening is slot-shaped with a greater extension in the radial than in the peripheral direction.

6. Apparatus as recited in claims 5 or 2 wherein said slot is defined by radial surfaces that are angled so that during rotation of the body they positively speed up the transport of the suspension through the opening.

7. Apparatus as recited in claim 3 wherein said cavity is separated from said opening by a dividing wall having at least one nozzle opening formed therein, and wherein said cavity has a diverging shape from said shaft to said opening.

8. Apparatus as recited in claim 2 wherein said means defining a through-extending opening defines a plurality of circumferentially spaced through-extending openings in said disc.

9. Mixing apparatus comprising: a vessel;

a disc-shaped body;

a hollow shaft mounting said disc-shaped body for rotation in said vessel;

means defining a through-extending opening in said disc-shaped body;

means defining a cavity in said body in operative communication with said hollow shaft and said through-extending opening;

means for introducing a fluid into said hollow shaft from an area remote from said vessel;

means for rotating said disc-shaped body within said vessel; and a dividing wall disposed between said through-extending opening and said cavity and means defining at least one nozzle in said dividing wall, said dividing wall located in a front surface of the through-extending opening relative to the direction of rotation of said disc-shaped body.

10. A method of mixing a fluid into a suspension, comprising the steps of:

(a) defining a flow path for the suspension past an area of mixing fluid introduction;

(b) moving the suspension along the flow path so that prior to and after the area of mixing fluid introduction it has a velocity below fluidizing velocity;

(c) effecting turbulent fluidization, at any given time, of only a small part of the suspension flowing in the flow path adjacent the area of mixing fluid introduction at the area of mixing fluid introduction;

(d) evenly and uniformly introducing mixing fluid into the fluidized part of the suspension when fluidized; and (e) progressively treating all parts of the suspension flowing in the flow path so at some time substantially the entire suspension flowing in the flow path will be subjected to turbulent fluidization and fluid introduction.

11. A method as recited in claim 10 wherein the suspension has a solids consistency of about 5–15%.

12. A method as recited in claim 11 wherein the suspension solids consistency is about 8–12%, and the suspension is comminuted cellulosic material in an aqueous medium.

13. A method as recited in claim 10 wherein the suspension is comminuted cellulosic material suspended in an aqueous medium, and wherein the mixing fluid is gaseous chlorine.

14. A method as recited in claim 10 wherein step (a) is practiced by defining a substantially circular cross-section substantially linear path for the suspension to flow through; and wherein step (b) is practiced by pumping the suspension along the path; and wherein steps (c)–(e) are practiced by: providing a circular disc of substantially the same, or slightly smaller, cross-sectional area as said flow path in said flow path, rotatable about an axis coextensive with or parallel to said flow path, and the disc having a through-extending opening formed therein; continuously rotating the disc about its axis of rotation; and introducing mixing fluid into suspension when the suspension is actually passing through the opening.

15. A method as recited in claim 14 wherein said disc rotation step is practiced so that said disc rotates in the range of about 300–1500 rpm.

16. A method as recited in claims 10, 14, or 15 wherein said steps (a)–(e) are practiced so that there is a pressure differential across the disc through-extending opening in the range of about 0.1–0.3 kg/cm$^2$.

* * * * *